US005358229A

United States Patent [19]

Groel et al.

[11] Patent Number: 5,358,229

[45] Date of Patent: Oct. 25, 1994

[54] APPARATUS FOR RECEIVING AND DISPENSING FLAT ARTICLES IN A PACKAGING MACHINE

[75] Inventors: John Groel, Long Valley, N.J.; Guenther-Eberhard Lade, Berglen, Fed. Rep. of Germany

[73] Assignee: Robert Bosch GmbH, Stuttgart, Fed. Rep. of Germany

[21] Appl. No.: 132,331

[22] Filed: Oct. 6, 1993

[30] Foreign Application Priority Data

Nov. 19, 1992 [DE] Fed. Rep. of Germany ..... 4238937

[51] Int. Cl.[5] ..... B65H 5/22; B65H 3/04

[52] U.S. Cl. ..... 271/3; 271/6; 271/9; 271/35; 271/265; 414/788.8; 414/797.6

[58] Field of Search ..... 271/3, 6, 7, 9, 35, 271/117, 147, 151, 162, 164, 165, 265; 414/788.4, 788.8, 794.4, 797.6

[56] References Cited

U.S. PATENT DOCUMENTS 2,776,831 1/1957 Shields ..... 414/797.6 X
3,378,251 4/1968 Donabin ..... 271/9 X
3,522,943 8/1970 Swanson ..... 271/6
4,465,192 8/1984 Ohba et al. ..... 271/9 X

FOREIGN PATENT DOCUMENTS 4003153 8/1991 Fed. Rep. of Germany .
659492 4/1979 U.S.S.R. ..... 271/165

*Primary Examiner*—Robert P. Olszewski
*Assistant Examiner*—Boris Milef
*Attorney, Agent, or Firm*—Edwin E. Greigg; Ronald E. Greigg

[57] ABSTRACT

An apparatus for receiving and dispensing flat articles, particularly folded boxes in a packaging machine including a conveyor system extending substantially in the horizontal plane, and a vertical dispensing chute. To increase the supply of folded boxes, in order to achieve longer reloading intervals between reloading operations, three storage apparatus are disposed above the conveyor system. Each of the storage apparatus has one support that can be lowered into the plane of the conveyor system, and a selection from among these storage apparatus is made by a control device, from signals from fill level sensors and feed sensors.

4 Claims, 2 Drawing Sheets

APPARATUS FOR RECEIVING AND DISPENSING FLAT ARTICLES IN A PACKAGING MACHINE

BACKGROUND OF THE INVENTION

The invention is directed to improvements in apparatus for receiving and dispensing flat articles in a packaging machine, in particular folded boxes which are lying flat. In one such apparatus, disclosed in German Offenlegungsschrift 40 03 153, for instance, folded boxes are delivered by means of a conveyor belt, on a substantially horizontally extending conveying plane, to a vertically disposed dispensing chute. The folded boxes are taken individually from the dispensing chute and transferred to a packaging machine. This apparatus, for the sake of a high yield of the packaging machine connected to it, requires constant supervision by operators, and frequent reloading of folded boxes by the operators.

OBJECT AND SUMMARY OF THE INVENTION

It is an object of the invention to provide the advantage over the prior art that the supply of folded boxes is increased by the storage means, so that less expense for supervision is required. If the apparatus is embodied as set forth herein, then the supply of folded boxes kept on hand is increased still further.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
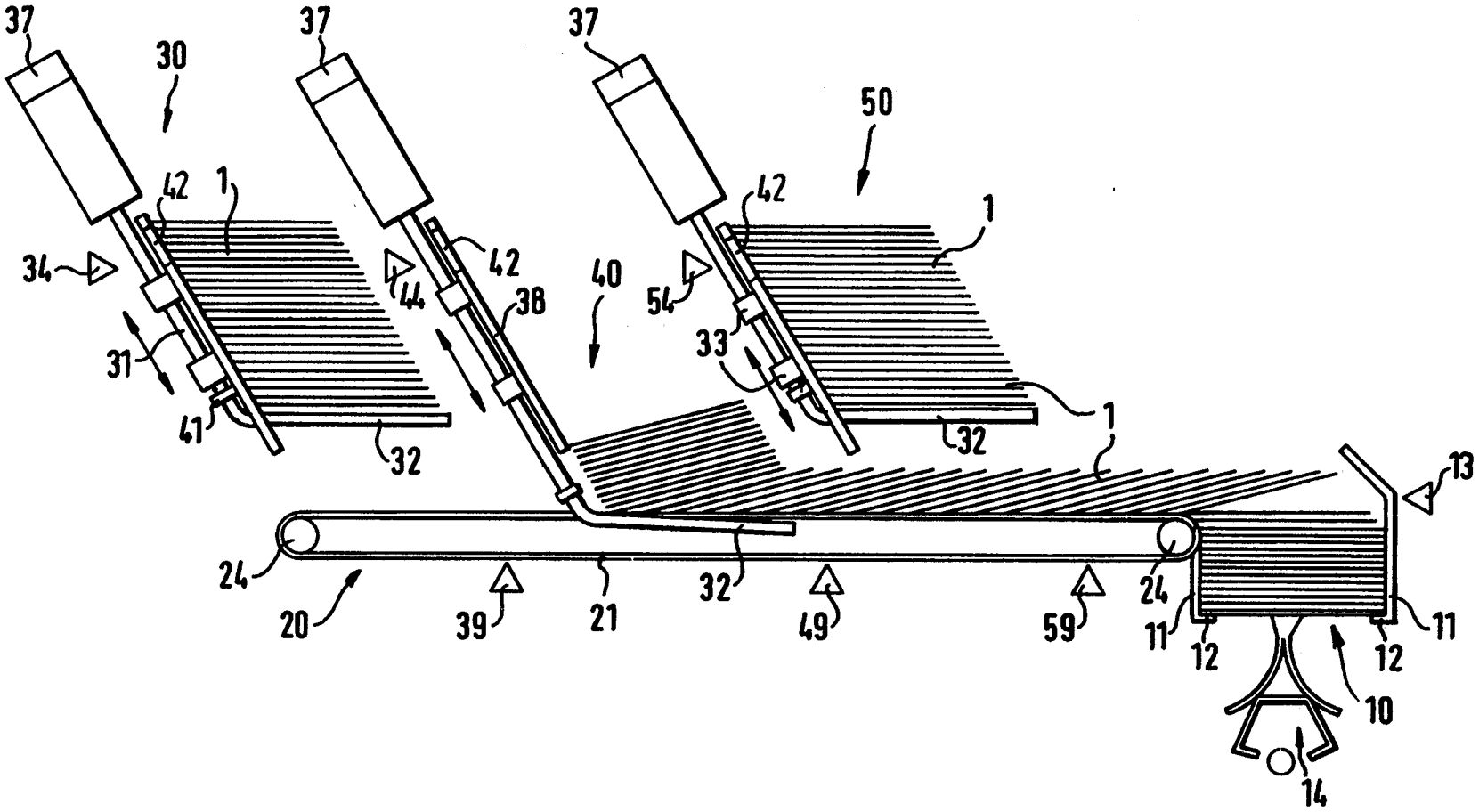
FIG. 1 shows an apparatus for receiving and dispensing folded boxes in a packaging machine, with three storage means, in a simplified view from the front.
Figure 2:
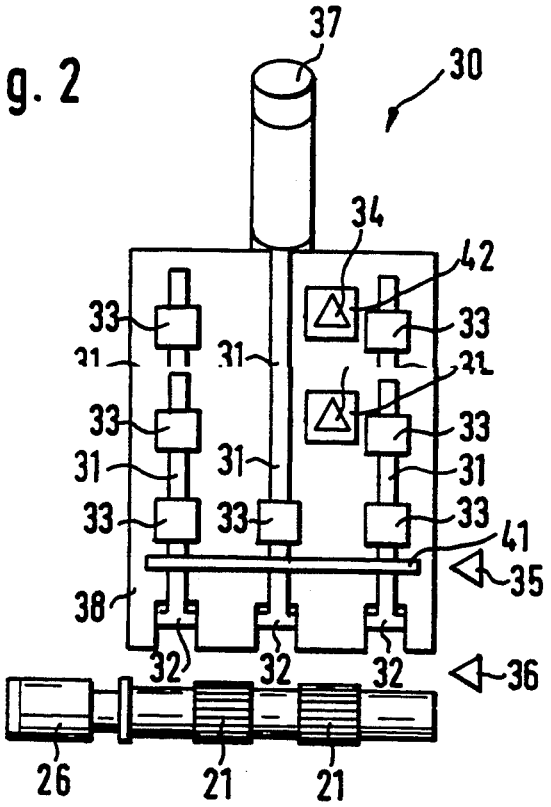
FIG. 2 shows the apparatus of FIG. 1 in a side view.
Figure 3:
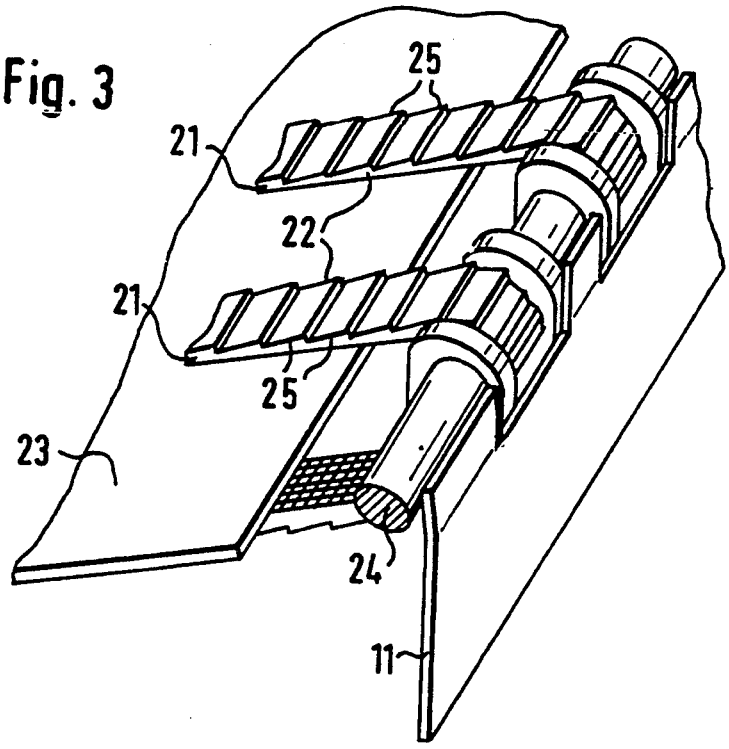
FIG. 3 shows the dispensing end of the conveyor system in a perspective view.

The apparatus for receiving and dispensing folded boxes has a dispensing chute 10, a conveyor system 20 for transporting the folded boxes 1 to the dispensing chute 10, and three storage means 30, 40, 50. The dispensing chute 10 substantially comprises opposed vertical guide walls or rails 11, which have retaining protrusions 12 on their lower ends, which are located in the same plane. A sensor 13 is disposed laterally of the dispensing chute 10 and detects the absence of a certain supply of folded boxes 1 in the dispensing chute 10. A movable suction head 14 is associated with the lower, open end of the dispensing chute 10 and pulls the lowermost folded box 1, resting on the retaining protrusions 12, downward out of the dispensing chute 10 at a given time and transfers the folded box to a conveyor system, not shown, of a packaging machine.

The conveyor system 20 has by way of example two parallel-extending endless conveyor belts 21, whose upper segments 22 rest on a table 23. The table 23 and the upper segments 22 extend substantially in a horizontal plane. At the beginning and end of conveying, the conveyor belts 22 are guided around deflecting rollers 24. The conveyor belts 21 have teeth 25 on their outside whose tips point in the conveying direction. The deflecting roller 24 at the end of conveying is driven by a motor 26.

Each of the storage means 30, 40, 50 has a forked support 31, a stationary back wall 38 with bearing elements 33 slidable on the support 31, fill level sensors 34, 44, 54, position sensors 35, 36, and a linear drive 37, for instance a pneumatic work cylinder. Moreover, each of the storage means 30, 40, 50 has an associated feed sensor 39, 49, 59 adjoining it in the conveying or conveying direction along the path of the conveyor system 20. The forked support 31 comprises three angled arms 32, which are firmly joined to one another by means of a crossbar 41 and are displaceably supported in the bearing elements 33. The linear drive 37 raises or lowers the supports 31 into an upper or lower position which is detected by the position sensors 35, 36. In the lowered position, the lower arms of the angled arms 32 penetrate the plane of the upper segments 22 of the conveyor belt 21, so that the folded boxes 1 stacked in the storage means 30, 40, 50 rest on and are pulled from the conveyor belts 21 one after another. In the upper position, the storage means 30, 40, 50 is refilled. The fill level sensor 34, 44, 54 detects a filled storage means 30, 40, 50 from a window 42 provided in the back wall 38. In the upper position of a storage means 30, 40, 50, it is assured that folded boxes 1 resting beneath it on the conveyor belt 21 and pulled out of another storage means 30, 40, 50 will be conveyed without hindrance. The above-described apparatus for receiving and dispensing folded boxes 1 functions as follows:

If the sensor 13 detects that the dispensing chute 10 is not filled up to a predetermined level, then the conveyor belts 21 are driven by the motor 26. By means of a memory-programmable control, a storage means 30, 40, 50 recognized as full via the associated fill level sensor 34, 44, 54 is lowered into the conveying plane; for example, the middle storage means 40 is so lowered. How this is done is that the linear drive 37 moves the forked support 31 downward until such time as the sensor 36 detects the lower end position of the support 31 and turns the linear drive 37 off. The prerequisite for the lowering process is that both the feed sensor 49 associated with the storage means 40 and the feed sensor 39 upstream of it, in the conveying direction of the conveyor system 20, generate an absence signal over a predetermined period of time. The folded boxes 1 are then gradually taken from the lowered storage area 40 and guided into the dispensing chute 10. As soon as the sensor 13 detects the predetermined fill level in the dispensing chute 10, the drive of the conveyor belts 21 is turned off. If the sensor 13 during operation detects that the dispensing chute 10 is no longer completely filled, then the drive of the conveyor belts 21 is turned on again, so that folded boxes 1 are again fed from the middle storage means 40 located in the lower position.

If the lowered storage means 40 has been emptied completely, then its associated feed sensor 49 generates an absence signal. The support 31 of the storage means 40 thereupon is moved to the upper position for refilling. If the sensor 13 during refilling of the storage means 40 again detects that the dispensing chute 10 has not been filled up to a predetermined level, then one of the other two filled storage means 30, 50, for instance the storage means 50, will be lowered into the lower position as described above. The control that selects one at a time of the storage means 30, 40, 50 for filling of the dispensing chute 10 decides this on the basis of the defined sequence, so that the fill level sensors 44, 54, 34, for instance, of the storage means 40, 50, 30 are polled in succession. If one of the storage means 30, 40, 50 is detected as not being filled, then the next storage means 30, 40, 50 detected as being full is selected.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. An apparatus for receiving and dispensing flat articles in a packaging machine comprising a conveyor system (20) having a dispensing end, a dispensing chute adjoining said dispensing end, storage means above said conveyor system for storing said flat articles, said flat articles to be dispensed are lying flat in a stack in said storage means above said conveyor system (20), said conveyor system (20) extends substantially in a horizontal plane, on which the flat articles that partly cover one another leading by their front edge region are delivered to said dispensing chute (10) adjoining said dispensing end of the conveyor system (20), said storage means (30) is disposed substantially vertically above the conveyor system (20) for refilling flat articles onto said storage means, said storage means (30) has a forked support (31) which can be lowered at least as far as a conveying plane of the conveyor system (20), a linear drive means (37) which dispenses the flat articles onto said conveyor system from said storage means, and the flat articles are carried along in succession by the conveyor system (20) to said dispensing chute.

2. An apparatus as defined by claim 1, in which a plurality of storage means (30, 40, 50) are disposed in succession in the conveying direction of the conveyor system (20).

3. An apparatus as defined by claim 2, in which one fill level sensor (34, 44, 54) is assigned to each of the plurality of storage means (30, 40, 50), and one feed sensor (39, 489, 59) adjoining each storage means (30, 40, 50) in the conveying direction is associated with one each storage means, so that articles are taken from one of the storage means (30, 40, 50), until such time as the associated feed sensor (39, 49, 59) generates an absence signal with respect to the presence of flat articles on one of said storage means, whereupon the emptied storage means (30, 40, 50) is raised from the conveying plane for refilling, and another storage means (30, 40, 50), of said plurality of storage means that is detected as filled with said flat articles via its fill level sensor (34, 44, 54) is lowered into the conveying plane of the conveyor system (20) for dispensing the flat articles onto said conveyor and into said dispensing chute.

4. An apparatus as defined by claim 3, in which one of the storage means (30, 40, 50) is lowered to the lower position if two of the fill level sensors (34, 44, 54) belonging to the plurality of storage means (30, 40, 50) and two of the feed sensors (39, 49, 59) located upstream of said feed sensors in terms of the conveying direction of the conveyor system (20), generate an absence signal.

* * * * *